United States Patent [19]

Vincent

[11] 4,240,259

[45] Dec. 23, 1980

[54] BOILER STEAM ENGINE WITH STEAM RECOVERY AND RECOMPRESSION

[76] Inventor: Ogden W. Vincent, 2166 La Miel Way, Campbell, Calif. 95008

[21] Appl. No.: 12,558

[22] Filed: Feb. 15, 1979

[51] Int. Cl.[3] ..... F01K 1/08

[52] U.S. Cl. ..... 60/670

[58] Field of Search ..... 60/670, 672, 655, 648, 60/39.05, 39.55

[56] References Cited

U.S. PATENT DOCUMENTS

| | | | |
|---|---|---|---|
| 4,104,869 | 8/1978 | Vincent | 60/39.55 |
| 4,116,005 | 9/1978 | Willyoung | 60/655 |

*Primary Examiner*—Stephen A. Kreitman

[57] ABSTRACT

A boiler type of steam engine is described which uses a conventional boiler with an external combustion chamber which heats water in a pressure chamber to produce steam. A mixing chamber is used to mix the steam from the boiler with recovered recompressed steam. Steam from the mixing chamber actuates a piston in a cylinder, thereafter the steam going to a reservoir in a heat exchanger where recovered steam is held and heated by exhaust gases from the combustion chamber. Recovered steam is then recompressed while being held saturated by a spray of water. Recovered steam from a steam accumulator is then used again in the mixing chamber. Thus, the steam is prevented from condensing and is recovered to be used again. The heat of the recovered steam is saved by this process.

12 Claims, 3 Drawing Figures

BOILER STEAM ENGINE WITH STEAM RECOVERY AND RECOMPRESSION

BACKGROUND OF THE INVENTION

In the past many boiler types of steam engines have been designed. The engines have all worked very well, so well that at the turn of the century most engines were steam engines of the boiler type. Of course in those days economy was not as important as it is now with fuel shortages in prospect. The poor efficiency of the old types of boiler steam engine were bypassed by more efficient internal combustion engines.

Recent efforts have been made to improve the efficiency of the steam engine by recovering and recompressing the steam. U.S. Pat. No. 4,104,869 is cited as an example of the new art of recovering the heat from exhausted steam and gases to produce new steam, thereafter the new steam being recompressed while the new steam is kept saturated. The engines of U.S. Pat. No. 4,104,869 are much more economical than internal combustion engines and the old type boiler steam engine.

Whereas the engines of U.S. Pat. No. 4,104,869 produce steam by direct contact and mixing with combustion gases in an external combustion chamber, this new steam engine uses a conventional boiler. Therefore, the combustion gases are not mixed with the steam as in the engines of U.S. Pat. No. 4,104,869 and do not need to be separated after expansion in a cylinder. The exhaust gases are exhausted to the atmosphere after passing through heat exchangers. Of course the steam is produced much faster in the engines of U.S. Pat. No. 4,104,869, but then the advantages of separation in a boiler are more practical in certain applications.

Another advantage of this new steam engine is that the exhaust steam is kept in a steam state before being recompressed whereas the engines of U.S. Pat. No. 4,104,869 condense the steam to water and then reheat the reclaimed water to make new steam. The advantage is that a large heat exchanger is not needed, a small one being sufficient. Another advantage is that there is no residue to be filtered from reclaimed water. The steam and water of this new engine is kept clean by separation.

Another advantage of this new steam engine is that a low pressure is all that is needed for the pressurized fuel supply and the pressurized oxygen supply. The engines of U.S. Pat. No. 4,104,869 require a high pressure for both the fuel supply and the oxygen supply. Therefore, less energy is needed to run these supplies and less expensive parts are needed in this new engine.

Being a mostly closed steam cycle, great economy can be the result in this new engine. The chief difference is that the exhaust gas contains a great deal of heat which goes to the atmosphere. Some of the exhaust gas heat is recovered in a heat exchanger whereas almost all of the gas heat is used or recovered in the engines of U.S. Pat. No. 4,104,869. Some economy is sacrificed to obtain the above advantages. Depending on the application, the advantages above greatly outweigh the disadvantage of extreme economy in the engines of U.S. Pat. No. 4,104,869.

SUMMARY OF THE INVENTION

An external combustion chamber in a boiler is used to heat water and steam in the pressure chamber of the boiler. Pressurized fuel and oxygen burn in the combustion chamber to produce heat that heats the water and steam in the steam chamber. The steam from the boiler mixes in a mixing chamber during a certain period with reclaimed steam which has previously been allowed to enter the mixing chamber. The heat from the boiler steam brings the reclaimed steam up to the same temperature and pressure as the boiler steam. The heated steam from the mixing chamber then enters a cylinder where the steam does work on a piston, the pressure and temperature falling in both the mixing chamber and the cylinder. Exhaust steam from the cylinder goes to a steam reservoir in a first heat exchanger where the steam is kept hot by exhaust gases from the combustion chamber. Reclaimed steam then goes to a steam compression cylinder where the reclaimed steam is recompressed while keeping the steam saturated by a spray of water from a pressurized water supply. Recompressed steam is held saturated in an accumulator where a spray of water keeps the steam saturated as required. Then the recompressed steam enters the mixing chamber to be reheated as before by boiler steam. There is a water reservoir in a second heat exchanger heated by the exhaust gases from the combustion chamber. Heated water from the water reservoir is pumped by a water pump to nozzles in the steam chamber, steam compression cylinder, and steam accumulator. An electromechanical control system has electronic circuits which control electric valves and an ignition device in response to various input signals.

DETAILED DESCRIPTION

Figure 1:
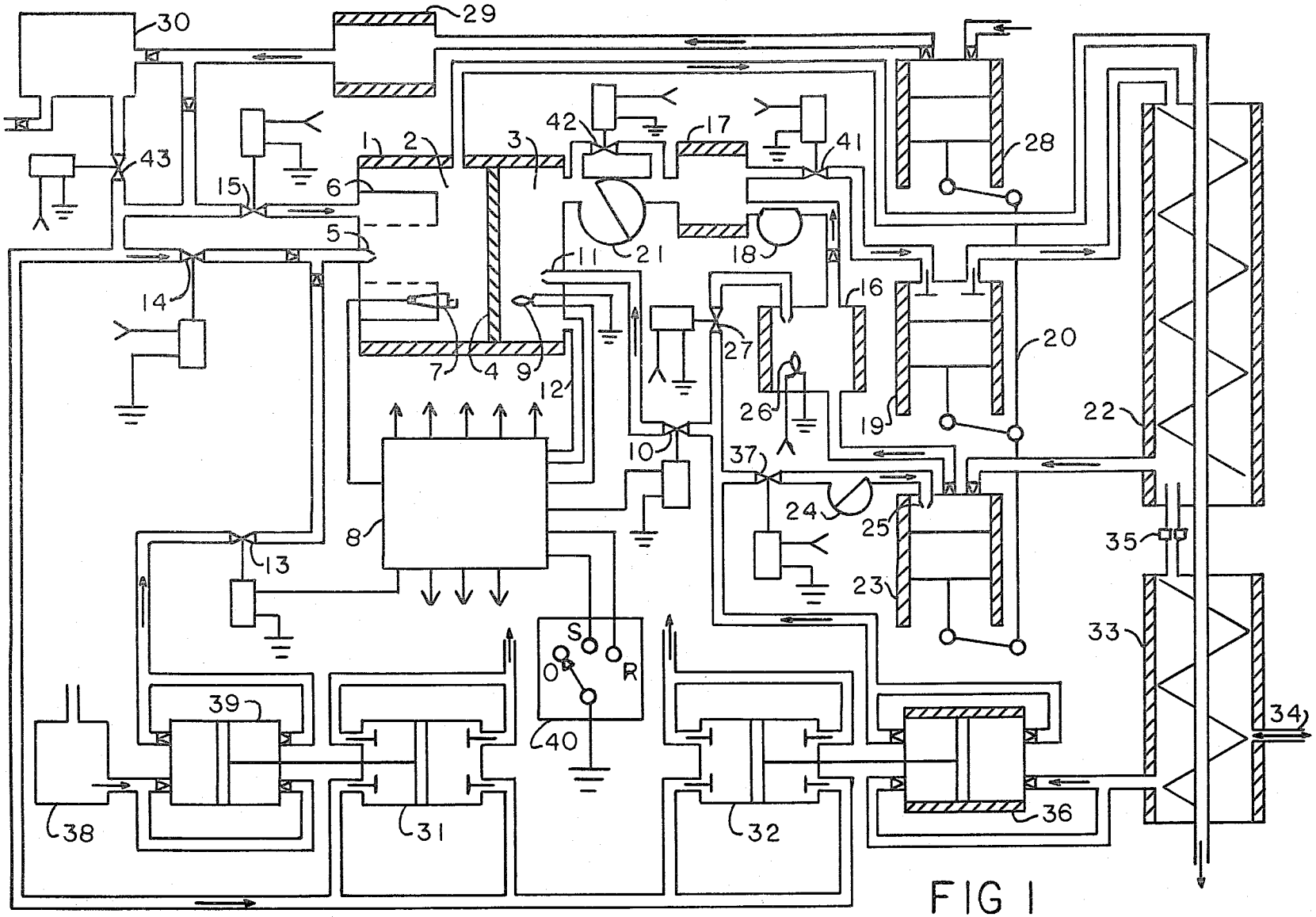
FIG. 1 is a schematic diagram of the steam engine.

The following description describes one example of the engine embodiment. FIG. 1 shows a schematic diagram of the example which will be referred to in subsequent paragraphs as the prototype.

The boiler 1 has two sections which are a combustion chamber 2 and a steam chamber 3, with a wall 4 inbetween. Pressurized fuel from nozzle 5 enters combustion chamber 2 where the fuel combines with pressurized oxygen from oxygen port and mixing collar 6. The fuel and oxygen mixture is ignited by spark plug 7 which receives high voltage pulses from electronic control 8. Hot combustion gases heat wall 4, thereby heating water and steam in steam chamber 3. When a predetermined temperature is sensed by temperature sensor 9, valve 10 opens and water from nozzle 11 is sprayed in steam chamber 3 to produce steam. When the pressure in pressure sensing tube 12 reaches a predetermined value, valve 13 closes and valve 14 opens. Air from valve 14 blows residual oil out of nozzle 5. After combustion stops, valves 14 and 15 close. For a continuously running engine valves 13 and 15 are open, and valve 14 is closed the majority of the time.

Reclaimed steam is held in a steam accumulator 16 from which the reclaimed steam is periodically admitted to mixing chamber 17 through pipe and valve 18. Reclaimed steam enters mixing chamber 17 when the pressure in 17 is low, just after the intake valve in work making cylinder 19 closes. Reclaimed steam enters mixing chamber 17 through a synchronous valve 18 which turns in synchronism with crankshaft 20. After valve 18 closes, synchronous valve 21 opens, allowing hot steam in chamber 3 to mix with reclaimed steam in chamber 17 via pipe, valve 21 being synchronous to crankshaft 20. After steam mixing in chamber 17 has occured, valve 21 closes, and the intake valve of cylinder 19 opens when the piston passes top dead center. Steam from chamber 17 pushes the piston down in cylinder 19, the steam expanding in both chamber 17 and cylinder 19. When the piston in cylinder 19 gets to bottom dead center, the intake valve closes and the output valve opens. Steam in cylinder 19 is pushed out through the output valve by the piston returning to top dead center. Of course there can be more than one piston like 19 with its associated mixing chamber 17.

Steam from cylinder 19 goes to the steam reservoir in first heat exchanger 22 via pipe. The reclaimed steam is held in first heat exchanger 22 which is held near atmospheric pressure, and the reclaimed steam in 22 is kept in a state of steam by the exhaust gases which come from combustion chamber 2 via pipe to heat the reclaimed steam. The reclaimed steam from first heat exchanger 22 flows via pipe to the input valve of a steam compressor cylinder 23 where the steam starts to enter after the piston reaches top dead center. The steam in cylinder 23 is compressed by the piston on the upstroke, at which time synchronous valve 24 opens, allowing pressurized water to be sprayed into cylinder 23 via pipe and nozzle 25. Thus, the steam in cylinder 23 is kept saturated while it is being compressed. Synchronous valve 24 revolves in synchronism with crankshaft 20. When the pressure in cylinder 23 reaches the pressure in steam accumulator 16, the output valve of cylinder 23 opens allowing steam to flow from 23 to 16 via pipe. As the pressure in accumulator 16 rises, the temperature is monitored by sensor 26. When the temperature in accumulator 16 exceeds a predetermined value, valve 27 opens allowing the pressurized water to enter 16 via pipe and valve 27, whereby the steam in 16 is kept saturated.

Air is compressed in cylinder 28 where air from the atmosphere enters the input valve when the piston passes top dead center. Air in cylinder 28 starts to compress when the piston passes bottom dead center and the input valve closes. Air is discharged from the output valve of cylinder 28 when the pressure reaches the pressure in the pipe leading to air accumulator 29. The pressure in accumulator 29 is moderate in the range of approximately 40 pisa. The compressed air from accumulator 29 flows by pipe and valves to an air reservoir 30, valve 14, valve 15, air motor 31, and air motor 32. When the air in air reservoir 30 reaches a predetermined value, excess air is vented to the atmosphere by a pressure relief valve.

Air motors 31 and 32 are run from the air pressure of either air reservoir 30 or air accumulator 29. Air is routed to either the left intake valve or the right intake valve of air motor 31 or 32 by a valve control mechanism which is not shown but works off the piston rod. The force of the air is converted to mechanical force on the rod by the area of the piston. The output valves of each motor 31 or 32 are also controlled by the valve control mechanism, the exhaust air going to the atmosphere.

The water system begins with a water reservoir in a second heat exchanger 33. A vent pipe 34 allows gas to pass in and out of second heat exchanger 33 and can be used to initially fill 33 with pure water. Excess steam and water from first heat exchanger 22 is allowed to pass through a restriction valve or device 35 in a pipe into second heat exchanger 33. Restriction device 35 allows the pressure in first heat exchanger 22 to bleed to almost atmospheric pressure. The exhaust gases from combustion chamber 2 flow via pipe through second heat exchanger 33 to heat the water to boiling temperature, thus capturing some of the heat from the exhaust gases. The water from second heat exchanger 33 flows via pipe to water pump 36 where the water is compressed to a value exceeding the pressure in steam chamber 3 by approximately 20 psi. Pressurized water flows by pipe from water pump 36 to water valves 10, 27, and 37. An input valve opens by input pressure as the piston in pump 36 moves away from it, and an output valve opens by pressure when the piston moves toward it and the pressure exceeds that in the output pipe.

The fuel system begins with a fuel reservoir 38 at atmospheric pressure. Fuel flows by pipe from fuel reservoir 38 to the input valves of fuel pump 39 where fuel is compressed to a pressure of approximately 40 psia. Fuel flows from the output valves of fuel pump 39 via pipe to fuel valve 13. An input valve opens by input pressure as the piston in pump 39 moves away from it, and an output valve opens by pressure when the piston moves toward it and the pressure exceeds that in the output pipe.

The electronic control 8 accepts signals from various signal producing devices and controls the operation of the engine. Switch 40 is a manual control for the operator. Pressure sensing tube 12 connects steam chamber 3 with a transducer in electronic control 8. Temperature sensors 9 and 26 connect to input circuits in electronic control 8. Electronic control 8 controls spark plug 7 and electric valves 10, 13, 14, 15, 27, 37, 41, 42, and 43. Electronic control 8 contains sensing circuits, logic circuits, and drive circuits.

STARTING AND RUNNING THE ENGINE

Initially air reservoir 30 contains the only residual pressure left in the engine. Valves 10, 13, 27, 37, 41, 42, and 43 are initially normally closed, and valves 14 and 15 are initially normally open. Switch 40 is switched to position S or start by the operator. Electronic control 8 closes valve 14, opens valves 13 and 43, and starts ignition sparks from spark plug 7, thus starting combustion in chamber 2. The steam and water in chamber 3 is brought to operating pressure. Switch 40 is then moved to position R or run. Valves 41 and 42 open, allowing the engine to run. After a certain time delay valves 42 and 43 close. After another time delay valve 37 opens allowing water injection in cylinder 23. The engine then runs automatically as previously described.

To turn the engine off switch 40 is moved to O or off. The valves return to the normally off position described above. Valve 41 closes stopping the engine. Combustion stops, but residual pressure will be maintained in chambers 3, 16, and 17 for awhile. Eventually steam will condense in chambers 3, 16, and 17, in cylinders 20 and 23, and in first heat exchanger 22. Of course, it would be adventageous to let the engine run without load at turn off so as much steam as possible leaves cylinder 19. All parts except air reservoir 30 eventually return to atmospheric pressure and fill with air. Residual water from condensed steam is reheated to steam when the engine is restarted.

THEORY OF OPERATION

Figure 2:
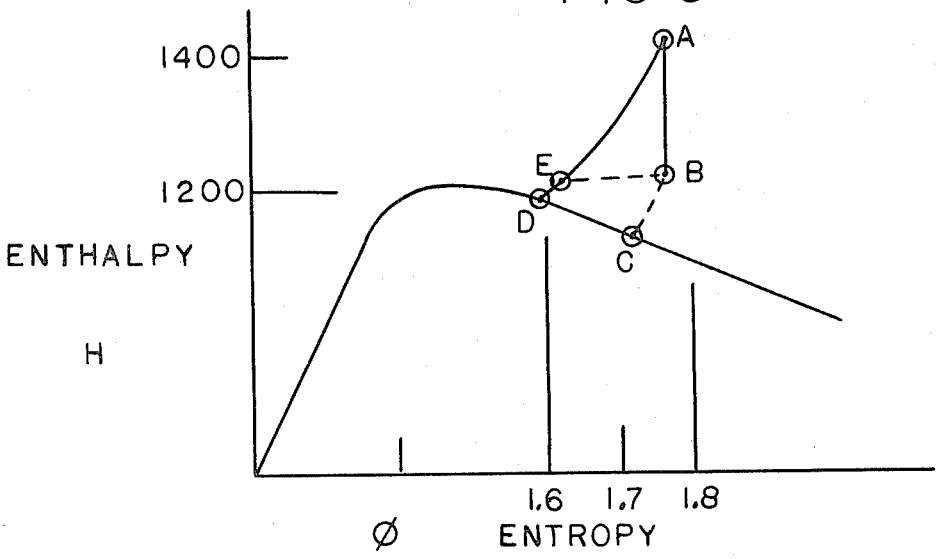
FIG. 2 is a graph showing the steam enthalpy-entrophy cycle of the engine.

The theory of the prototype is explained by the following example. Refer to FIG. 2 which is a small copy of "A Mollier Chart Of The Properties Of Steam" upon which is drawn the cycle of the engine. Steam from mixing chamber 17 enters cylinder 19, being point A on FIG. 2 which is 770° F. and 160 psia. The steam expands adiabatically in cylinder 19 and mixing chamber 17, progressing to point B. Steam left in mixing chamber 17 is at point B which is 375° F. and 30 psia. The work done by a pound of steam is 1415−1225=190 BTU. There is 0.28 pound of steam left in mixing chamber 17 when the input valve of cylinder 19 closes. The piston in cylinder 19 does 190 BTU of work per pound of steam.

0.72 pound of steam is exhausted from cylinder 19 into first heat exchanger 22 where it expands to approximately atmospheric pressure or point C in FIG. 2 which is 14.7 psia and 212° F. Compression in cylinder 23 takes place while the steam is kept saturated, and this process is shown between points C and D on FIGS. 2 and 3. The heat of compression is absorbed by the water spray from nozzle 25. The work of compression is obtained by taking the area in FIG. 3 and multiplying by 0.72 pound which gives 106 BTU done by the piston in cylinder 22. 0.11 pound of water is required by nozzle 25 to absorb the heat of compression, meaning only 0.61 pound of steam is required from first heat exchanger 22. Therefore, 0.11 pound of excess steam must pass into second heat exchanger 33 to become water. Heat is lost upon condensing, amounting to approximately 107 BTU. Presuming that all the rest of the steam which is 0.89 lb remains steam, a savings of 864 BTU is saved over that of an old time boiler that exhausts all the steam to the atmosphere.

Figure 3:
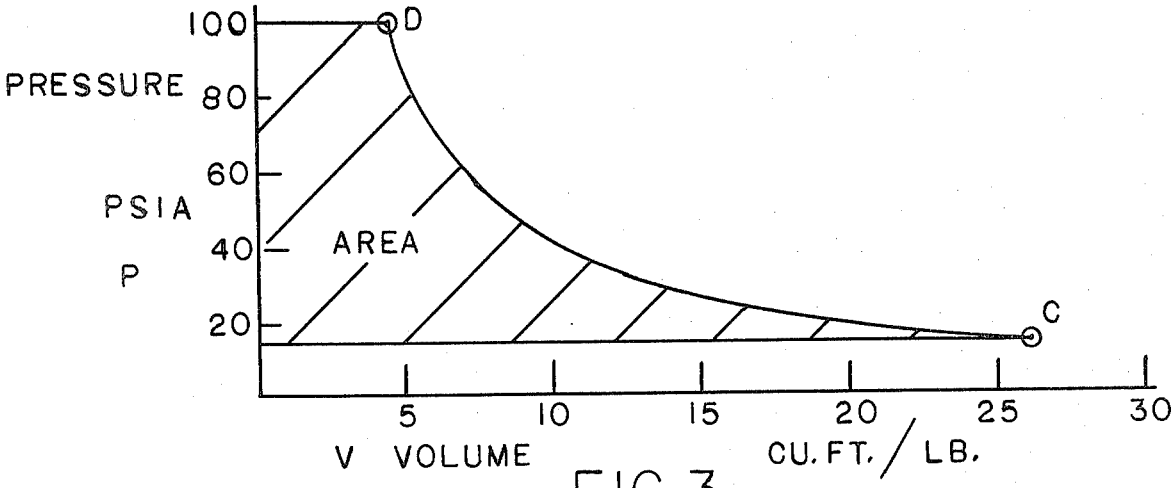
FIG. 3 is a graph showing the pressure-volume cycle of steam recompression.

The steam in steam accumulator 16 is at point D in FIG. 2 and 3 which is 100 psia and 327° F. The residual 0.28 lb of steam left in mixing chamber 17 is mixed with steam from accumulator 16, progressing to point E on the chart. Then the steam in mixing chamber 17 is mixed with the steam from steam chamber 3 bringing the cycle back to point A again where it originally started. Line D-E-A is a constant specific volume line of 4.4 cu ft/lb which was derived from steam tables.

Air is compressed adiabatically in cylinder 28 from 14.7 psia to 40 psia. Assuming an efficiency of 75% for the boiler, 0.19 lb of air is needed to burn 0.0145 lb of kerosene fuel. 13.1 lb of air are needed for each lb of fuel. It is calculated that 8.3 BTU are required to compress the air, and this heat is retained by the air, contributing to the heat in combustion chamber 2. The heat from the fuel is 283 BTU. The total heat given to the steam in chamber 3 is (283+8.3)0.75=219 BTU which is required to heat the pound of steam from point E to point A or 1415−1196=219 BTU.

This type of engine is economical, clean burning, pollution free and quiet running. In this analysis it is presumed that there is no mechanical friction, fluid friction, leakage, turbulence, or heat transfer. Therefore, the following parts are shown insulated in FIG. 1: boiler 1, mixing chamber 17, cylinders 19, 23 and 28, heat exchangers 22 and 23, steam accumulator 16, air accumulator 29, and pump 36. Other interconnecting parts are insulated also. The work of compressing the fuel and water is small and is not included. From the above figures the work out is the work by cylinder 19 minus cylinders 23 and 28 or 190−106−8.32=75.7 BTU. The heat from the fuel is 283.2 BTU. The theoretical efficiency is 75.7/283.2=26.8%.

It is to be understood that the embodiment described herein is merely an example of the principles of the invention. Various modification thereto may be effected by persons skilled in the art without departing from the spirit and scope of the invention.

What is claimed is:

1. A steam engine comprising:

a boiler means having a combustion chamber and having a pressurized steam chamber, said combustion chamber having a fuel injection device, an exhaust port, an oxygen port, and a fuel ignition device, said oxygen port injecting on oxygen bearing gas to be mixed with fuel during combustion, said exhaust port exhausting spend combustion gases to the atmosphere via a first pipe, said steam chamber having a water injection device for injecting pressurized water and having a temperature sensing element, an output port of said steam chamber being connected to a transducer by a second pipe, steam and water in said steam chamber being heated by combustion gases in said combustion chamber via at least one wall of said boiler, a steam port of said steam chamber being connected to the mixing port of a steam mixing means by a third pipe and valves, said steam mixing means being a pressurized vessel with a mixing port, an output port and an input port which is connected to the output port of a steam accumulator means via a fourth pipe and valve, said mixing means mixing stem from said steam chamber with preinjected steam from said steam accumulator means, a work means having an input that is connected to the output port of said mixing means by a fifth pipe valve, said work means doing work by steam expansion, thereby transmitting work via a drive shaft, the output of said work means exhausting steam to the input port of a steam reservoir via a sixth pipe, said steam reservoir having a input port, an output port, and a drain port, a steam compressor means having an output and having an input that is connected to the output port of said steam reservoir, said compressor means having a water injection device for the injection of pressurized water during compression, said steam compressor means receiving motivation energy from said work means, said pressurized steam accumulator means having an output port and an input port that is connected to the output of said steam compressor means, an air compressor means having an input connected to the atmosphere and an output connected to an air accumulator, said air compressor means receiving motivation energy from said work means, the output of said air accumulator being connected to an air reservoir and to said oxygen port via a seventh pipe and valves, a pressure producing fuel pump means having an input connected to a fuel tank and an output connected to said fuel injection device by an eighth pipe and and valves, said fuel pump means receiving motivation energy from said work means, a pressure producing water pump means having an input connected to the output port of a water reservoir, the output of said water pump means connecting via a ninth pipe and valves to a plurality of water injection devices, said water pump means receiving motivation energy from said work means, said water reservoir having an input port, an output port and a vent port that is connected to the atmosphere, the input port of said water reservoir connecting to the drain port of said steam reservoir by a tenth pipe and at least one valve, and an electro-mechanical control means using electronic and mechanical signals from components as input signals, said control operating a plurality of valves in pipe lines, said control means generating output electronic signals and mechanical functions to control engine functions.

2. The engine of claim 1 wherein said boiler further comprises a fuel valve in said eigth pipe being controlled to allow continuous fuel injection, thereafter fuel injection stopping when a predetermined pressure in said steam chamber is reached, a gas valve from said seventh pipe to said oxygen port opening when fuel is injected, a gas valve from said seventh pipe in the gas input to said fuel injection device opening for a short time fuel injection stops, and a water injection valve from said ninth pipe opening in response to excess temperature in said steam chamber, thereby water being injected.

3. The engine of claim 2 wherein said mixing means further comprises a valve in said fourth pipe being synchronized to said drive shaft, thereby opening periodically for steam injection in said mixing chamber, a valve in said third pipe being synchronized to said drive shaft, thereby opening periodically after steam injection by the valve in said fourth pipe to allow gas mixing, and an output valve in said fifth pipe opening to run the engine.

4. The engine of claim 3 wherein said work means further comprises at least one piston in a cylinder connected to said drive shaft via connecting links, at least one input valve synchronized to said drive shaft, thereby opening periodically for input steam to do work on pistons, and at least one output valve synchronized to said drive shaft, thereby opening periodically for steam to be forced out by piston force.

5. the engine of claim 4 wherein said steam compressor further comprises at least one piston in a cylinder connected to said drive shaft via connecting links, at least one steam input valve opening by the pressure of said steam reservoir, at least one steam output valve opening by cylinder pressure, a water valve from said ninth pipe to water injection devices being synchronized to said drive shaft, thereby opening during compression, and at least one water injection device injecting water in a cylinder.

6. The engine of claim 5 wherein said air compressor means further comprises at least one piston in a cylinder connected to said drive shaft via connecting links, at least one air input valve opening by input pressure, and at least one air output valve opening by cylinder pressure.

7. The engine of claim 6 wherein said steam accumulator means further comprises a pressurized vessel having a water injection device for injecting pressurized water, a heat sensing device signaling in response to temperature, and a water injection valve from said ninth pipe opening in response to excess steam temperature.

8. The engine of claim 7 wherein said control means further comprises a function switch producing fuction signals, electronic circuits receiving input signals and generating output currents to control electric valves in pipes, heat sensing elements producing electronic signals for said electronic circuits in response to temperature, said electronic circuits producing high voltage pulses for a spark plug in said combustion chamber, and at least one pressure transducer producing an electronic signal for said electronic circuits in response to pressure.

9. The engine of claim 8 wherein said steam reservoir further comprises a first heat exchanger, wherein said first pipe exchanges heat from spent combustion gases to heat said steam reservoir:

10. The engine of claim 9 wherein said water reservoir further comprises a second heat exchanger, wherein said first pipe exchanges heat from spent combustion gases to heat said water reservoir.

11. The engine of claim 1 wherein said steam reservoir further comprises a first heat exchanger, wherein said first pipe exchanges heat from spent combustion gases to heat said steam reservoir.

12. The engine of claim 11 wherein said water reservoir further comprises a second heat exchanger, wherein said first pipe exchanges heat from spent combustion gases to heat said water reservoir.

* * * * *